US006173065B1

(12) United States Patent
Lin

(10) Patent No.: US 6,173,065 B1
(45) Date of Patent: Jan. 9, 2001

(54) STRUCTURE OF SPEAKER

(76) Inventor: Steff Lin, 8F., No. 18, Lane 30, Kuo Hsing St., Hsi Chih Chen, Taipei Hsien (TW)

( * ) Notice: Under 35 U.S.C. 154(b), the term of this patent shall be extended for 0 days.

(21) Appl. No.: 09/365,768

(22) Filed: Aug. 3, 1999

(51) Int. Cl.[7] ..... H04R 25/00

(52) U.S. Cl. ..... 381/398; 381/403; 381/404; 181/171

(58) Field of Search ..... 381/396, 398, 381/403, 404, 405, 407, 420, 423, 431; 181/171, 172

(56) References Cited

U.S. PATENT DOCUMENTS 4,190,746 * 2/1980 Hardwood et al. ..... 381/404
4,379,952 * 4/1983 Kaizer et al. ..... 381/404
4,472,604 * 9/1984 Nakamura et al. ..... 381/425
5,511,131 * 4/1996 Kohara et al. ..... 381/396
5,687,247 * 11/1997 Proni ..... 381/403
5,848,173 * 12/1998 Sato et al. ..... 381/403
5,848,174 * 12/1998 Ki et al. ..... 381/405

* cited by examiner

*Primary Examiner*—Curtis A. Kuntz
*Assistant Examiner*—Suhan Ni
(74) *Attorney, Agent, or Firm*—Bacon & Thomas, PLLC

(57) ABSTRACT

In a speaker, a first corrugated damping device and a second corrugated damping device are arranged on a stepped portion inside a cone rack and vertically spaced by a spacer ring, and a third corrugated damping device is suspended above the first and second corrugated damping device and secured to a back member at the back side of the cone rack to stabilize a paper cone in the cone rack.

1 Claim, 3 Drawing Sheets

STRUCTURE OF SPEAKER

BACKGROUND OF THE INVENTION

The present invention relates to speakers, and more particularly to such a speaker, in which multiple corrugated damping devices are installed to stabilize the sound coil and the paper cone, so as to eliminate a harmonic distortion.

During the operation of a speaker, the sound coil tends to be oscillated, and the paper cone tends to be tilted, thereby causing a harmonic distortion. In order to eliminate this problem, a speaker manufacturer may install a corrugated damping device to stabilize the sound coil. However, this arrangement cannot stabilize the paper cone.

SUMMARY OF THE INVENTION

The present invention has been accomplished to provide an improved structure of speaker, which eliminates the aforesaid problem. According to the present invention, a first corrugated damping device and a second corrugated damping device are arranged on a stepped portion inside the cone rack and vertically spaced by a spacer ring to stabilize the sound coil, and a third corrugated damping device is suspended above the first and second corrugated damping device and secured to a back member at the back side of the cone rack to stabilize the paper cone in the cone rack.

DETAILED DESCRIPTION OF THE PREFERRED EMBODIMENT

Figure 1:
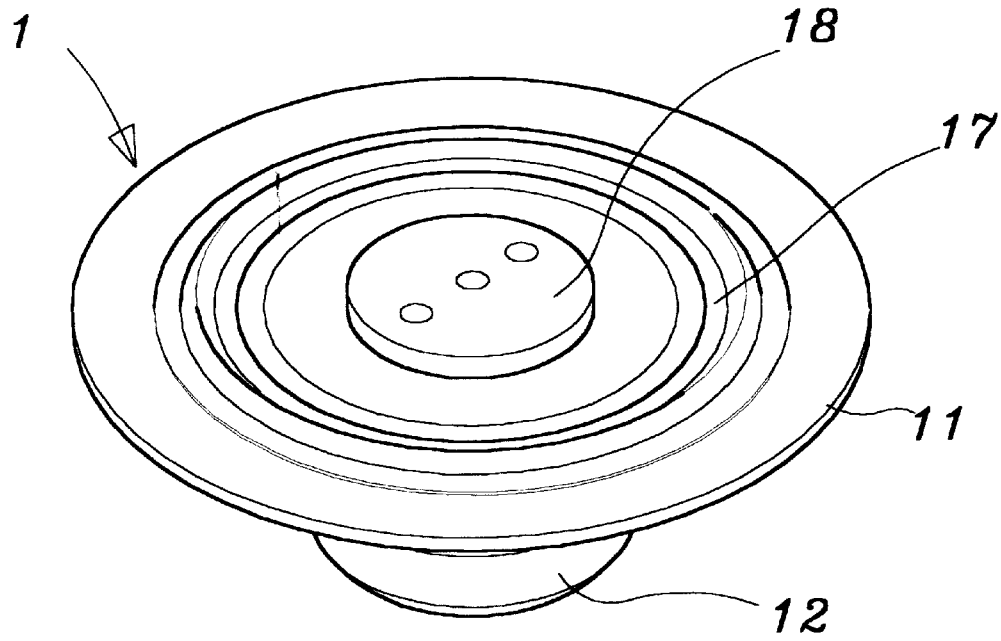
FIG. 1 is an exploded view of a speaker according to the present invention.
Figure 2:
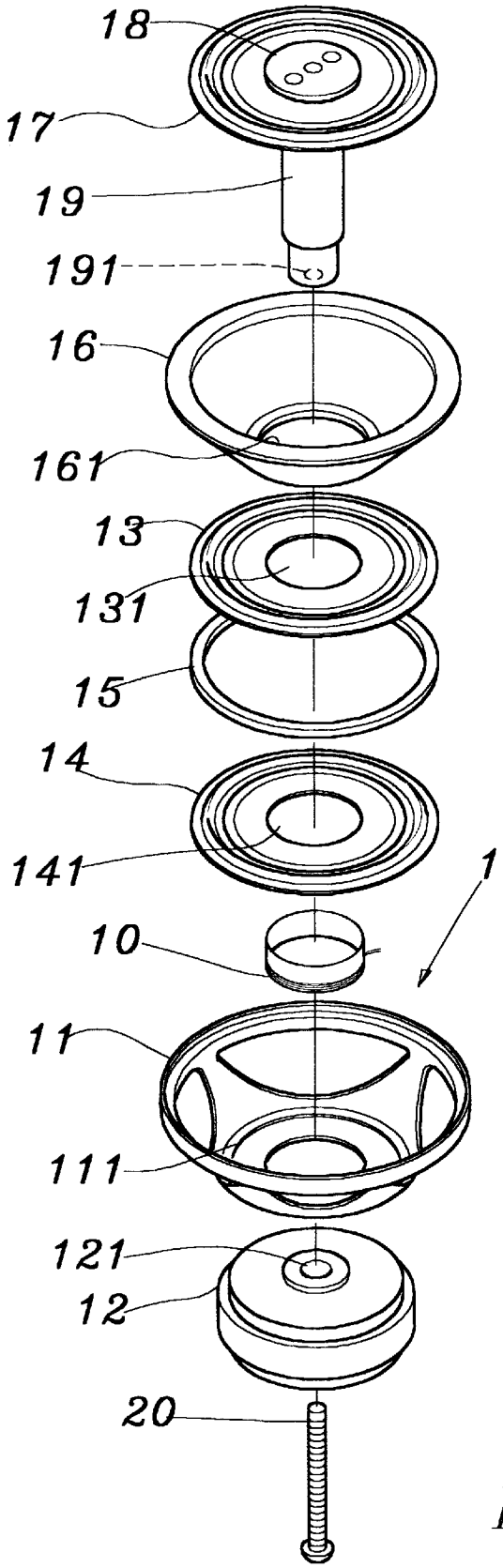
FIG. 2 is an elevational assembly view of the speaker shown in FIG. 1.

Referring to FIGS. 1 and 2, a speaker 1 is shown comprised of a cone rack 11 having a stepped portion 111 on the inside, a back member 12 fastened to the bottom side of the cone rack 11, the back member 12 having a center mounting hole 121 through the center axis of the upright center rod thereof, a sound coil 10 mounted around the center rod of the back member 12, a first corrugated damping device 14 mounted on the stepped portion 111 inside the cone rack 11 and spaced above the sound coil 10, a spacer ring 15 retained between the first corrugated damping device 14 and the second corrugated damping device 13, and a paper cone 16 mounted in the cone rack 11 above the second corrugated damping device 13.

The speaker 1 further comprises a third corrugated damping device 17 mounted within the paper cone 16, a disk 18 fixedly fastened to the third corrugated damping device 17 at the enter, and a mounting rod 19 fixedly and perpendicularly connected to the disk 18 at the bottom side of the third corrugated damping device 17. The mounting rod 19 is inserted in proper order through the center hole 161 at the paper cone 16, the center hole 131 at the second corrugated damping device 13, the center hole 141 at the first corrugated damping device 14 and then plugged into the center mounting hole 121 at the back member 12, and then a screw 20 is mounted in the center mounting hole 121 at the back member 12 from the bottom side and threaded into a screw hole 191 at the bottom end of the mounting rod 19 to fix the mounting rod 19 to the back member 12, enabling the third corrugated damping device 17, the paper cone 16, the second corrugated damping device 13, the locating ring 15, and the first corrugated damping device 14 to be firmly secured to the cone rack 11. The arrangement of the corrugated damping devices 13, 14 and 17 enables the sound coil 10 and the paper cone 16 to be firmly retained in place, so that audio distortion is minimized.

Figure 3:
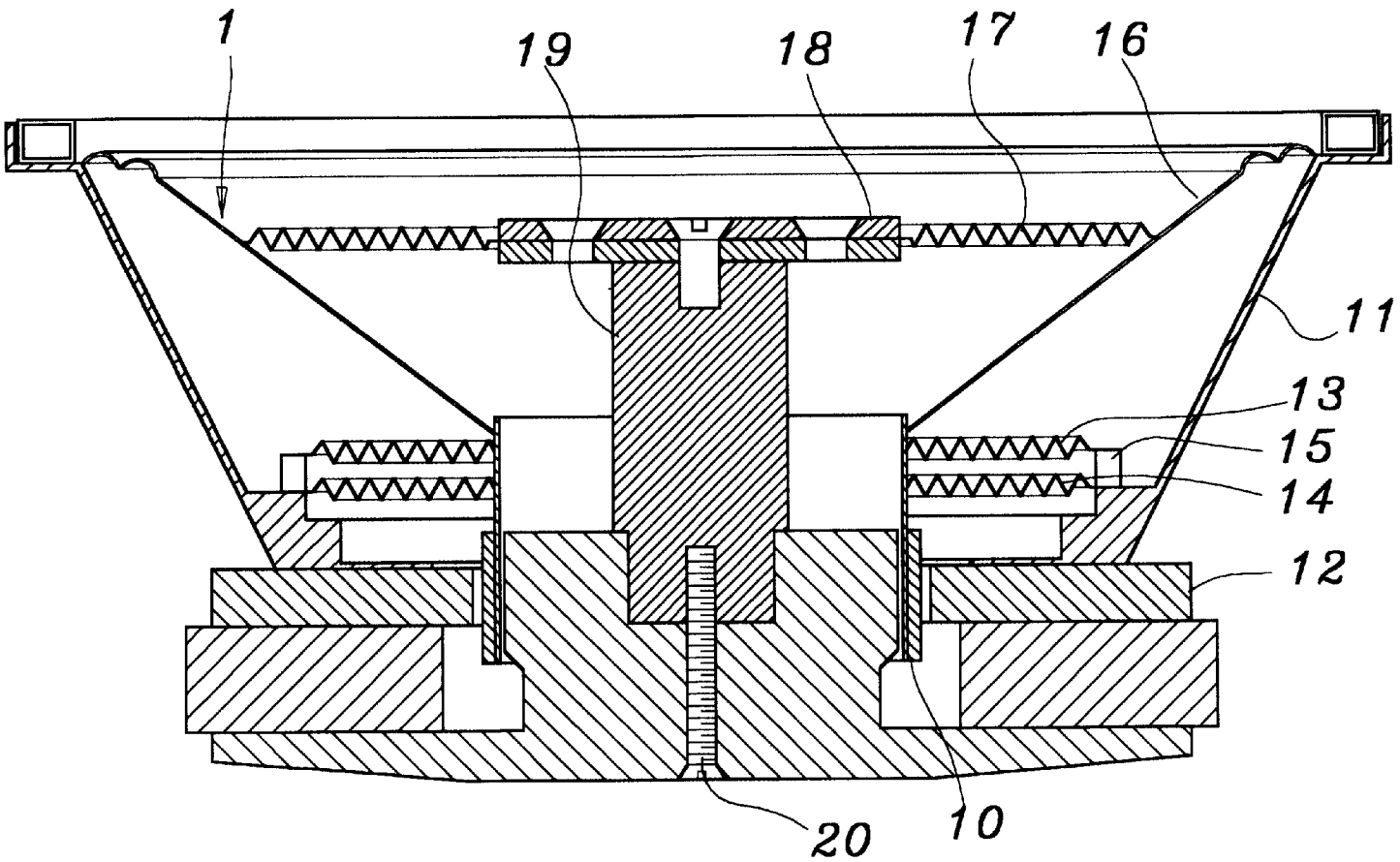
FIG. 3 is a side view in section in an enlarged scale of the speaker shown in FIG. 2.

The assembly process of the present invention is outlined hereinafter with reference to FIG. 3, the first corrugated damping device 14 is arranged on the stepped portion 111 inside the cone rack 11, then the spacer ring 15 is mounted on the first corrugated damping device 14, and then the second corrugated damping device 13 is placed on the spacer ring 15, and then the paper cone 16 is mounted in the cone rack 11, and then the assembly of the third corrugated damping device 17, disk 18 and mounting rod 19 is put in the paper cone 16, enabling the mounting rod 19 to be plugged into the center mounting hole 121 at the back member 12, and then the screw 20 is threaded into the screw hole 191 at the bottom end of the mounting rod 19 to fix all members together. When assembled, the first and second corrugated damping devices 13 and 14 are secured to the sound coil 10 to stop the sound coil 10 from tilting, and the third corrugated damping device 17 is suspended inside the paper cone 16. When the paper cone 16 is vibrated during the operation of the speaker 1, the third corrugated damping device 17 stabilizes the vibration of the paper cone 16 to eliminate a harmonic distortion.

What the invention claimed is:

1. A speaker comprising a cone rack, said cone rack having a stepped portion on the inside, a back member fastened to said cone rack at a bottom side, said back member having a center mounting hole, a first corrugated damping device and a second corrugated damping device mounted on said stepped portion inside said cone rack, a sound coil suspended inside said cone rack below said first corrugated damping device and said second corrugated damping device, and a paper cone mounted in said cone rack above said first corrugated damping device and said second corrugated damping device, an improvement comprising a spacer ring supported between said first corrugated damping device and said second corrugated damping device, a third corrugated damping device suspending in said paper cone and peripherally disposed in contact with said paper cone on the inside, a disk fixedly provided at the center of said third corrugated damping device, a fixed mounting rod perpendicularly and downwardly extended from said disk and inserted through a hole at the center of said second corrugated damping device and a hole at the center said first corrugated damping device and plugged into the center mounting hole at said back member, said mounting rod having a bottom screw hole, and a screw mounted in the center mounting hole and threaded into the bottom screw hole at said mounting rod to fix said mounting rod to said back member.

* * * * *